United States Patent [19]

Geers

[11] Patent Number: 5,048,090

[45] Date of Patent: Sep. 10, 1991

[54] HEARING AID WITH TRANSMITTER AND MICROPHONE HOUSING PARTS

[75] Inventor: Wolfgang Geers, Dortmund, Fed. Rep. of Germany

[73] Assignee: Horgeraete Geers GmbH & Co. KG, Dortmund, Fed. Rep. of Germany

[21] Appl. No.: 434,147

[22] Filed: Nov. 13, 1989

[30] Foreign Application Priority Data

Nov. 11, 1988 [DE] Fed. Rep. of Germany ... 8814162[U]

[51] Int. Cl.[5] ..... H04R 25/00

[52] U.S. Cl. ..... 381/68.6; 381/69; 381/68

[58] Field of Search ..... 381/68, 68.6, 68.7, 381/69, 69.2; 181/135, 130

[56] References Cited

U.S. PATENT DOCUMENTS 3,312,789 4/1967 Lewis et al. ..... 381/69.2
3,414,685 12/1968 Geib et al. ..... 381/68.6
3,783,201 1/1974 Weiss et al. ..... 381/68.6
3,852,540 12/1974 Diethelm ..... 381/68.6
4,679,240 7/1987 Heide ..... 381/68
4,712,245 12/1987 Lyregaard ..... 381/68.6

FOREIGN PATENT DOCUMENTS 274900 11/1987 Japan ..... 381/68.6

*Primary Examiner*—Jin F. Ng
*Assistant Examiner*—Jason Chan
*Attorney, Agent, or Firm*—Townsend and Townsend

[57] ABSTRACT

A hearing aid is described comprising a transmitter housing part and a microphone housing part associated with the external ear, together with associated actuating units and is characterized in that the microphone housing part is formed as a plastic hook or an at least partially elastically deformable unit adaptable individually to the curve of the concha, and in that the microphone is arranged in the end region remote from the transmitter housing part.

10 Claims, 4 Drawing Sheets

HEARING AID WITH TRANSMITTER AND MICROPHONE HOUSING PARTS

BACKGROUND OF THE INVENTION

The invention relates to a hearing aid comprising a transmitter housing part intended to be received in the auditory canal of the ear and a microphone housing part associated with the auricle (external ear), and also a unit integrated into the housing for loudness level regulation, in particular a unit accessible for manual actuation.

Such in-ear devices are known and are extensively used in practice. With such devices an endeavour is made to obtain above all, in addition to a technical operation which is as good as possible, a small manner of construction which permits a largely inconspicuous wearing of the hearing aid.

SUMMARY OF THE INVENTION

The object underlying the invention is to form a hearing aid of the initially named kind in such a way that an individual adaptation to the particular user is possible without impairing the technical operation and to ensure high wearing comfort while ensuring particularly good ventilation of the ear.

This object is satisfied in accordance with the invention essentially in that the microphone housing part is formed as a plastic hook adaptable individually to the curve of the concha and the microphone is arranged in the end region of this plastic hook remote from the transmitter housing part.

Through this plastic hook an individual adaptation to the arc of the concha can be obtained, with the amplifier preferably being integrated into the plastic hook in the region of the antitragus, and with a sensor control preferably being used for loudness regulation, with the actuating pins of the sensor control lying in the anthelix region. The end region of the plastic hook containing the microphone is arranged in the upper part of the ear in the cymba fold (in German Cymbafalte).

The transmitter housing part preferably has a releasable auditory canal portion which contains the transmitter, which is of substantially cylindrical shape and which has a spherical end provided with an opening. This auditory canal portion is screwed to the connection portion formed as a battery receiving chamber to form the plastic hook, so that as a whole a two-part capsule element is present which is both favourable from the point of installation and also permits problem-free changing of the battery in the form of a button cell, since for this purpose it is merely necessary to open a readily accessible snap-fitting cover.

In accordance with an advantageous embodiment of the invention the sleeve associated with the auditory canal is of kinked construction in order to achieve the best possible adaptation to the anatomy of the ear.

Further advantageous layouts and features of the invention are set forth in the subordinate claims.

An embodiment of the invention will be explained in more detail with reference to the drawing in which are shown:

DETAILED DESCRIPTION OF THE INVENTION

Figure 1:
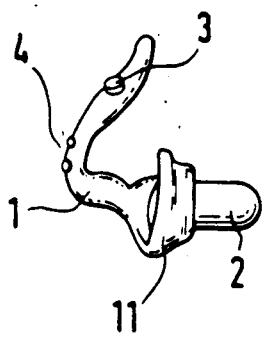
FIG. 1 a side view of a hearing aid in accordance with the invention.

The hearing aid shown in FIG. 1 comprises a microphone housing part 1 and a transmitter housing part 2 with the transition region being shaped in the form of a connection portion 11 which is located at the entry to the auditory canal after insertion of the hearing aid by the user.

The microphone housing part 1 is formed as a plastic hook which is individually matched to the respective curve of the concha of the user. A microphone 3, an amplifier and also a unit 4 for loudness regulation are integrated into this plastic hook 1, with the actuation of this unit 4 for loudness regulation preferably taking place via two easily actuable sensor pins.

Figure 2:
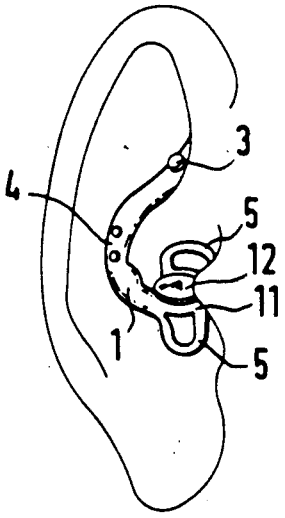
FIG. 2 an illustration of the hearing aid of FIG. 1 in the ear of a user, FIG. 3 a schematic sectional illustration of the transmitter housing part of the hearing aid of FIG. 1, FIG. 4 an illustration corresponding to FIG. 3 in a section displaced through 90° in comparison to FIG. 3, FIG. 5 a sectional illustration of a variant of the transmitter housing part of FIG. 3, and FIG. 6 a schematic illustration to explain a variant of the plastic hook which includes the microphone housing part.

FIG. 2 shows the arrangement of the hearing aid 1 in an ear and it can above all be seen that as a result of the shape of the microphone housing part 1 in the form of a plastic hook a very individual adaptation is possible to the prevailing circumstances by the respective wearer of the hearing aid, and the visible regions of the apparatus are thereby minimised.

The plastic hook 1 matched to the curvature of the concha contains the amplifier in the region of the antitragus and the microphone 3 is arranged in the upper part of the ear in the cymba fold. The unit 4 for loudness regulation has a sensor control, the actuating pins of which lie in the anthelix region. In the region of the entry to the auditory canal the connection portion 11 is provided with hoop-like support elements 5 and a snap fitting cover 12 behind which the battery is located is accessible between these support elements 5.

Figure 3:
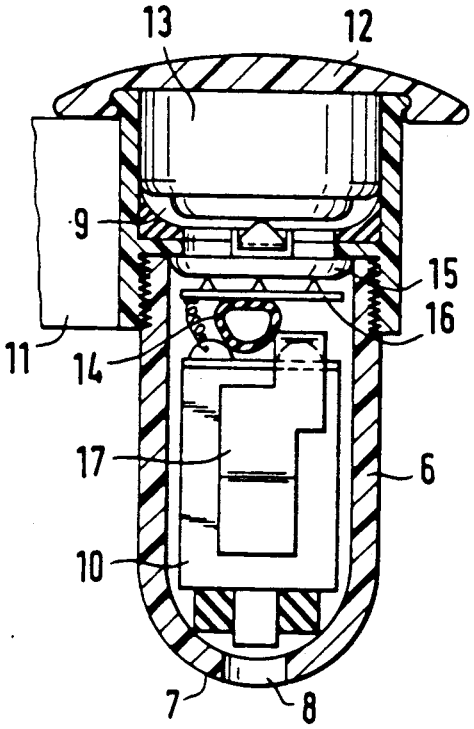
Figure 4:
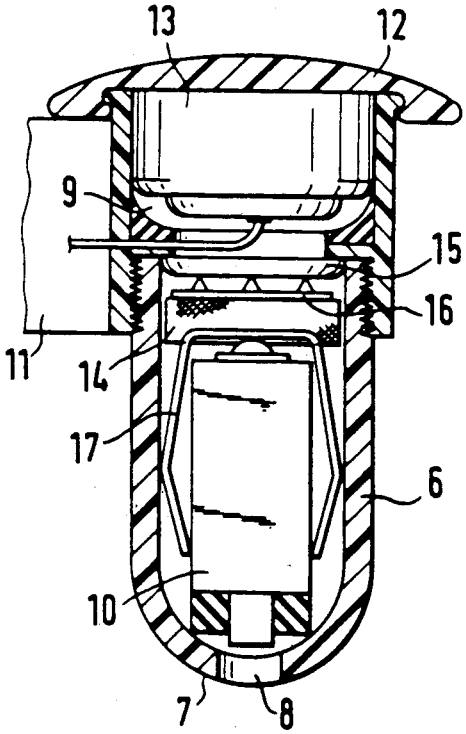

FIGS. 3 and 4 show the transmitter and energy supply part of the hearing aid in mutually displaced sectional illustrations.

In this arrangement the transmitter 10 is arranged in a cylindrical auditory canal portion 6 which is hemispherically shaped at its free end 7 and which has an opening 8. This housing part can be unscrewed. In the upper region associated with the connection portion 11 there is provided a battery receiving chamber 9 which is closed towards the outside with a cover 12, which is preferably held via a snap-in latch connection. A button cell 13 is located in this battery receiving chamber 9.

While the electrical connections between the microphone, amplifier and loudness regulator take place via corresponding connection lines, the electrical connections in the transmitter housing part itself are in particular realised via a transmitter contact circuit board 15 and a connection circuit board 16, and also via transmitter contacts 17, so that problemfree installation is possible and any eventual interchange procedures during repairs or checks are made easier.

The contact pressure required between the transmitter contact circuit board 15 and the connection circuit board 16 is achieved via a spring element 14 which preferably comprises an elastic hose part which is arranged between the connection circuit board 16 and the transmitter 10.

Figure 5:
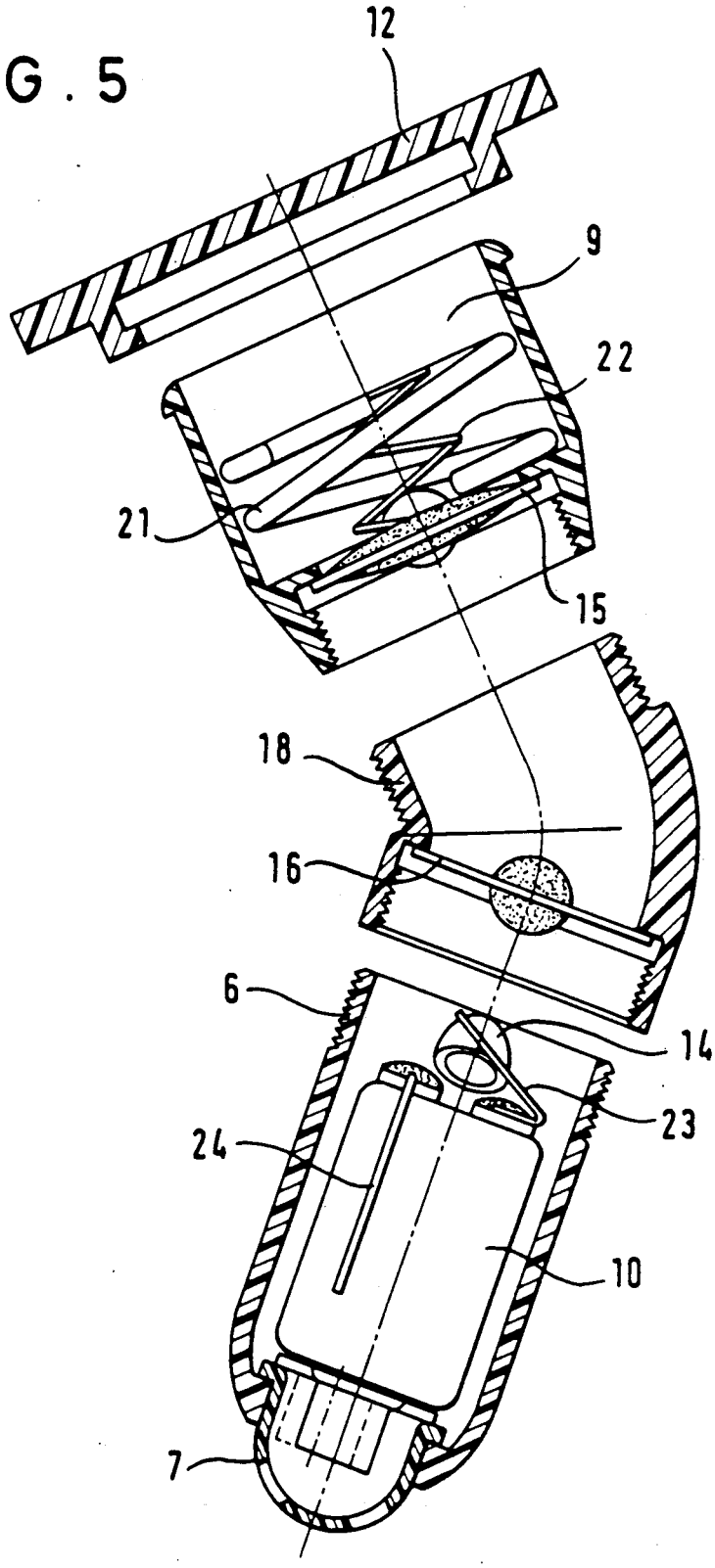

FIG. 5 shows a variant of the transmitter housing part shown in FIG. 3, with corresponding parts being characterised with the same reference numerals.

The housing portion containing the battery receiving chamber 9 is, as already shown in FIG. 4, again held in the connection portion 11. In the battery receiving chamber 9 there is located a battery spring 21 associated with the positive battery terminal and also weaker battery spring 22 which is disposed within the spring 21 and is associated with the negative battery terminal.

The transmitter 10 is arranged with the associated transmitter leaf spring 23 and transmitter bar spring 24 and also the spring element 14 consisting of a silicone hose part in a cylindrical housing portion, and an angled piece 18 with an integrated connection circuit board 16 is provided between this cylindrical housing portion and the housing portion containing the battery receiving chamber 9 and ensures an ideal adaptation to the anatomy of the ear. This sleeve-like angled piece 18 can be screwed to the housing parts which are to be connected to both ends.

Figure 6:
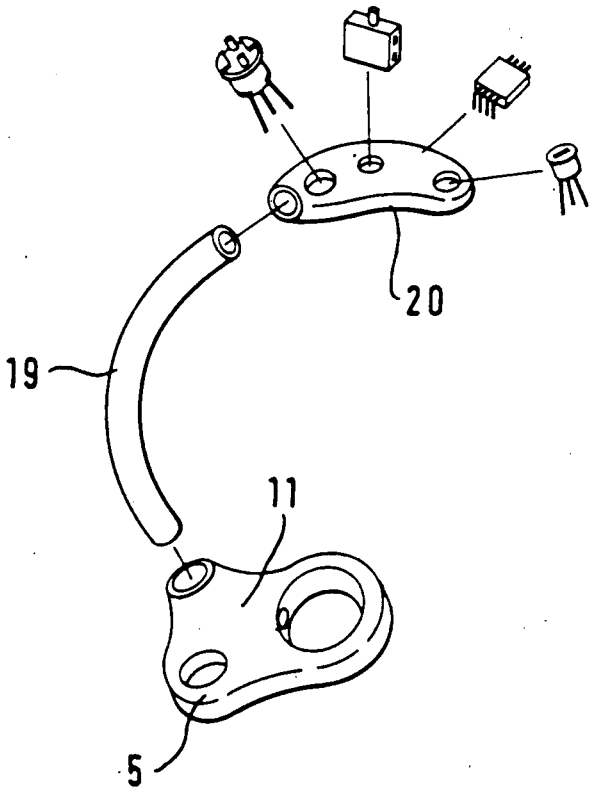

FIG. 6 shows in schematic illustration a possible variant of the unit containing the microphone part and this unit consists in this case of a hose-like element 19 and a shaped housing part 20. The hose-like element 19 is so connected with the connecting portion 11 and the shaped housing part 20 that passage of the required electrical lines is possible. In the shaped housing part 20 there are accommodated, in addition to the microphone, the further electrical and electronic components that are required and the associated actuating elements, with an arrangement of these members and elements being possible in the smallest space. The shaped housing part can be so formed that an additional adaptation to anatomic circumstances is possible through deformation of regions thereof or by encasing it.

It will be noted that in accordance with the invention the plastic hook may be of resilient plastic so that it exerts a light gripping action when inserted in the ear or it may be of a deformable plastic so that it may be bent or otherwise deformed prior to or after insertion to conform closely to the shape of the ear.

Furthermore, the term hook will be understood in a very general sense to mean a curved part, e.e. of scythe-like shape, there is no intended implication that this part is curved, e.g. like a fish hook or curtain hook. Important is that the part is shaped to follow the curve of the concha.

I claim:

1. Hearing aid comprising a transmitter housing part to be received in the auditory canal of the ear, a microphone housing part to be positioned in the auricle, a unit accessible for manual operation integrated into the microphone housing part for loudness level regulation, the microphone housing part being formed as a plastic hook adaptable individually to the curve of the concha to extend substantially along the antitragus region of the ear, a microphone being arranged in an end region of the plastic hook remote from the transmitter housing part so that the microphone is positioned in an upper part of the ear in the cymba fold thereof.

2. Hearing aid in accordance with claim 1, wherein the unit for loudness regulation is integrated into the plastic hook in a region between the microphone and the transmitter housing part, the unit including sensor contacts for actuating it.

3. Hearing aid in accordance with claim 1, including at least one hoop-like support element molded on in the region of the transition between the transmitter housing part and the microphone housing part formed as the plastic hook.

4. Hearing aid in accordance with claim 1 wherein, the transmitter housing part has a releasable auditory canal portion housing a transmitter, the auditory canal portion having a substantially cylindrical shape and a hemispherical end provided with an opening.

5. Hearing aid in accordance with claim 4, wherein the auditory canal portion is screwed to a connection portion formed as a battery receiving chamber.

6. Hearing aid in accordance with claim 5, including an angle piece, in particular an angle piece adapted to be screwed into place for adaptation of the auditory canal portion to the anatomy of the ear, the angle piece being positioned between the battery receiving chamber and the region of the auditory canal portion which receives the transmitter.

7. Hearing aid in accordance with claim 6, wherein the battery receiving chamber is held in the connecting portion and is accessible via a cover formed as a snap-in latching cover.

8. Hearing aid in accordance with claim 1, including a transmitter aid contact circuit board and a resiliently mounted connection board which cooperates with the transmitter contact board, the boards being located in a auditory canal portion and arranged between a button cell and a transmitter.

9. Hearing aid in accordance with claim 8, wherein the connection circuit board is supported relative to the transmitter via a resilient spring element formed in hose-like manner and comprising silicone.

10. Hearing aid in accordance with claim 1 wherein the plastic hook comprises a hose-like element attached to a connection portion and a shaped housing part housing the microphone and further electrical functional and operating elements.

* * * * *